US006041834A

United States Patent [19]

Fujikawa et al.

[11] Patent Number: 6,041,834

[45] Date of Patent: Mar. 28, 2000

[54] LIQUID FILLING DEVICE

[75] Inventors: Yasuji Fujikawa; Takashi Arao; Michio Ueda, all of Tokushima, Japan

[73] Assignee: Shikoku Kakoki Co., Ltd., Tokushima, Japan

[21] Appl. No.: 09/144,626

[22] Filed: Aug. 31, 1998

[30] Foreign Application Priority Data

Sep. 17, 1997 [JP] Japan ..... 9-252182

[51] Int. Cl.[7] ..... B65B 43/42

[52] U.S. Cl. ..... 141/172; 141/90

[58] Field of Search ..... 141/89–93, 97, 141/172, 129, 275–278, 48, 63

[56] References Cited

U.S. PATENT DOCUMENTS

| | | | |
|---|---|---|---|
| 4,964,444 | 10/1990 | Hanerus et al. | 141/90 |
| 5,267,591 | 12/1993 | Wakabayshi et al. | 141/90 |
| 5,533,550 | 7/1996 | Franke et al. | 141/90 |
| 5,720,326 | 2/1998 | Kaneko | 141/172 |

FOREIGN PATENT DOCUMENTS

| | | |
|---|---|---|
| 32 24 544 | 1/1984 | Germany . |
| 2 216 885 A2 | 10/1989 | United Kingdom . |

*Primary Examiner*—Henry J. Recla
*Assistant Examiner*—Khoa D. Huynh
*Attorney, Agent, or Firm*—Armstrong, Westerman, Hattori, McLeland and Naugton

[57] ABSTRACT

A liquid filling device comprises a filling nozzle 31 for filling contents into containers C being transported by a conveyor 13, and a lifter 34 for lifting the container C to be filled from the path of transport of the conveyor. The filling nozzle 31 has a lower portion providing a vertical cylinder portion 42 fittable with the container C to be lifted by the lifter 34. The filling nozzle 31 is provided with an air cover 51 comprising a top wall and a peripheral wall extending downward from an edge portion of the top wall. The filling nozzle 31 extends through the top wall, with its vertical cylinder portion 42 projecting into the air cover 51. The air cover 51 has connected thereto an outlet end of a dry air pipe 52.

2 Claims, 4 Drawing Sheets

LIQUID FILLING DEVICE

BACKGROUND OF THE INVENTION

The present invention relates to liquid filling devices for filling milk, or like liquid, into containers.

Filling devices of the type mentioned are already known which comprise a filling nozzle for filling contents into containers being transported by a conveyor, and a lifter for lifting the container to be filled from the path of transport by the conveyor. The filling nozzle has a lower portion providing a vertical cylinder portion fittable with the container to be lifted by the lifter. A dry air duct for preventing condensation of water vapor has an outlet opening positioned above the filling nozzle and facing downward.

Dry air is forced against the filling nozzle at all times, so that the device described requires a large quantity of dry air and therefore a high running cost for producing the dry air, and is uneconomical.

SUMMARY OF THE INVENTION

An object of the present invention is to provide a liquid filling device comprising a filling nozzle which is rendered free of condensation of water vapor thereon with a minimum quantity of dry air required and which is therefore low in running cost for producing dry air to ensure economy.

The present invention provides a liquid filling device comprising a filling nozzle for filling contents into containers being transported by a conveyor, and a lifter for lifting the container to be filled from a path of transport, the filling nozzle having a lower portion providing a vertical cylinder portion fittable with the container to be lifted by the lifter, the liquid filling device being characterized in that the filling nozzle is provided with an air cover, the air cover comprising a top wall and a peripheral wall extending downward from an edge portion of the top wall, the filling nozzle extending through the top wall, at least the vertical cylinder portion of the entire filling nozzle projecting into the air cover, the air cover having connected thereto an outlet of a dry air pipe.

With the liquid filling device embodying the invention, the filling nozzle is provided with an air cover which comprises a top wall and a peripheral wall extending downward from the edge portion of the top wall, the filling nozzle extending through the top wall, with at least the nozzle vertical cylinder portion projecting into the air cover, the air cover having connected thereto an outlet of a dry air pipe. Accordingly, the dry air forced out from the outlet of the air pipe is confined in the air cover, forming a dry air atmosphere within the air cover. This prevents the condensation of water vapor on at least the vertical cylinder portion of the filling nozzle. Consequently, the quantity of dry air to be forced out from the outlet of the dry air pipe can be smaller to result in a reduced running cost for producing dry air and assure economy.

Preferably, the air cover comprises a fixed cover, and a movable cover removably attached to the fixed cover.

Removal of the movable cover from the fixed cover assures the filling nozzle of facilitated maintenance.

Further preferably, the dry air pipe comprises a fixed pipe, and a movable pipe having one end removably connected to the fixed pipe and the other end providing the outlet, the movable pipe having its outlet end secured to the movable cover.

When the movable pipe is removed with the movable cover, the dry air pipe will not interfere with the movable cover when this cover is to be removed from, or attached to, the fixed cover. This renders the movable cover removable or attachable with ease.

When the movable pipe comprises a flexible hose, the movable pipe is easy to remove from the fixed pipe or to connect thereto.

DESCRIPTION OF THE PREFERRED EMBODIMENT

An embodiment of the present invention will be described below with reference to the drawings.

In the following description, the terms "front" and "rear" are based on FIG. 2; the left-hand side of FIG. 2 will be referred to as "front," and the opposite side thereof as "rear." The terms "left" and "right" refer respectively to the left-hand side and the right-hand side of FIG. 1.

Figure 1:
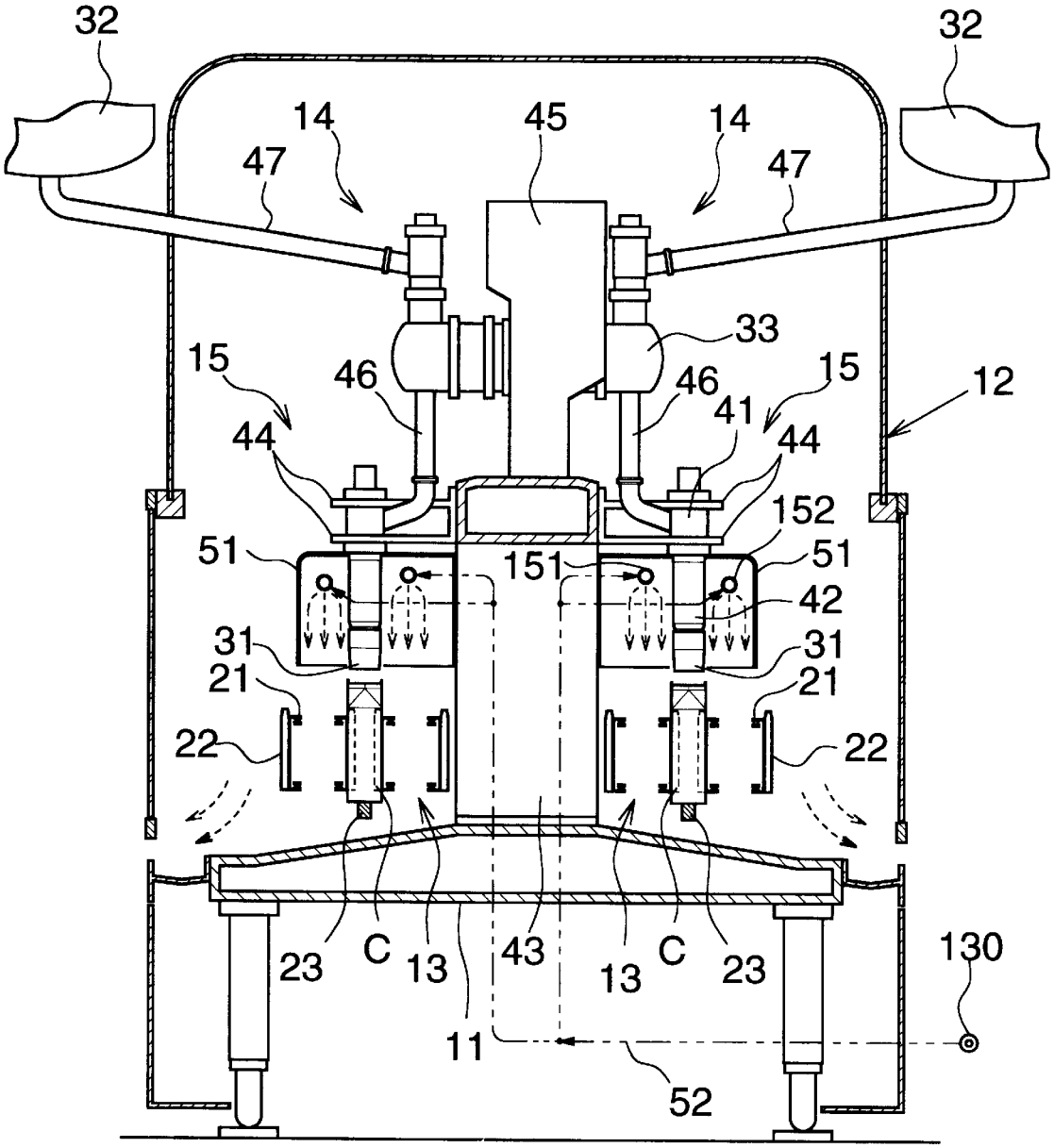
FIG. 1 is a front view of a liquid filling device according to the invention.
Figure 2:
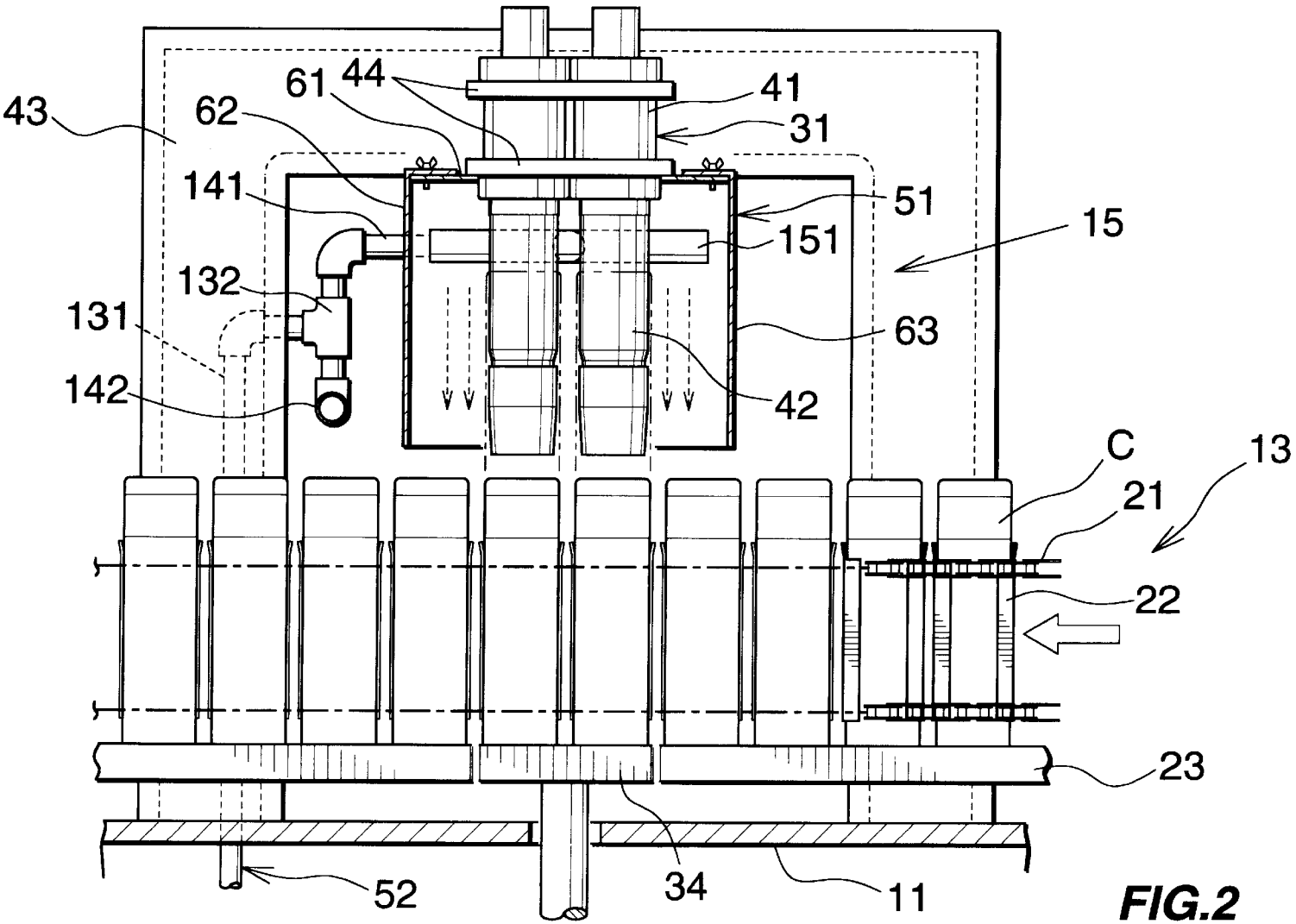
FIG. 2 is a side elevation of the device.

FIGS. 1 and 2 show a bed 11, a clean booth 12 covering the bed 11 from above and in the form of a box left open at its bottom side, a container conveyor 13 provided inside the clean booth 12 and having two container transport paths extending in parallel to each other and arranged respectively at left and right for forwardly transporting containers C each having a bottom and a square to rectangular cross section, left and right filling devices 14 provided inside the clean booth 12 by extension therethrough from outside thereof. The filling devices correspond to the left and right transport paths respectively, and left and right condensation preventing devices 15 are provided for the respective filling devices 14.

An air discharge clearance is formed between the upper side of the bed 11 and the lower end of the clean booth 12. The interior of the clean booth 12 is held at a positive pressure with clean air.

The two conveyor transport paths at the left and right are of the same construction. Each transport path has left and right endless chains 21 movable in circulation in opposite directions to each other in a horizontal plane, holders 22 attached to the chains 21 at a suitable interval for holding containers C upwardly or downwardly movably, and a guide rail 23 for supporting and guiding the bottoms of the containers C held by the holders 22. The chains 21 of each path are so driven that the containers C held by the holders 22 are intermittently transported through a distance corresponding to two containers arranged in a row at a time by each cycle of intermittent conveyor drive operation.

The left and right filling devices 14 are of the same construction although facing toward opposite directions transversely of the transport paths. Each filling device 14 comprises two filling nozzles 31 arranged side by side along the transport path thereabove in corresponding relation with the distance the containers are transported at a time, a filling liquid tank 32 disposed outside the clean booth 12, a metering cylinder 33 incorporating an unillustrated piston which operates to cause a specified quantity of the liquid to be filled to flow into the cylinder from the tank 32 and subsequently to flow out of the cylinder into the filling nozzle 31, and a lifter 34 for moving the container C upward and downward relative to the conveyor 13 so as to maintain a constant distance between the lower end of the nozzle 31 and the liquid level within the container during filling.

The filling nozzle 31 is generally in the form of a vertical cylinder in its entirety, and comprises an upper large diameter portion 41 and a lower small diameter portion 42. The large diameter portion 41 is fixed by a bracket 44 to a gate frame 43 provided between the two transport paths. When raised by the lifter 34, the container C is fitted to the small diameter portion 42.

The metering cylinder 33 is mounted on a box frame 45 provided on the top of the gate frame 43, and is connected to the filling nozzle 31 by a downstream pipe 46 and to the liquid tank 32 by an upstream pipe 47.

The left and right condensation preventing devices 15 have the same construction although facing toward opposite directions transversely of the transport paths. Each of the devices 15 comprises an air cover 51, and an air pipe 52 for supplying dry air to the interior of the air cover 51. The condensation preventing device 15 at right will be described below.

Figure 4:
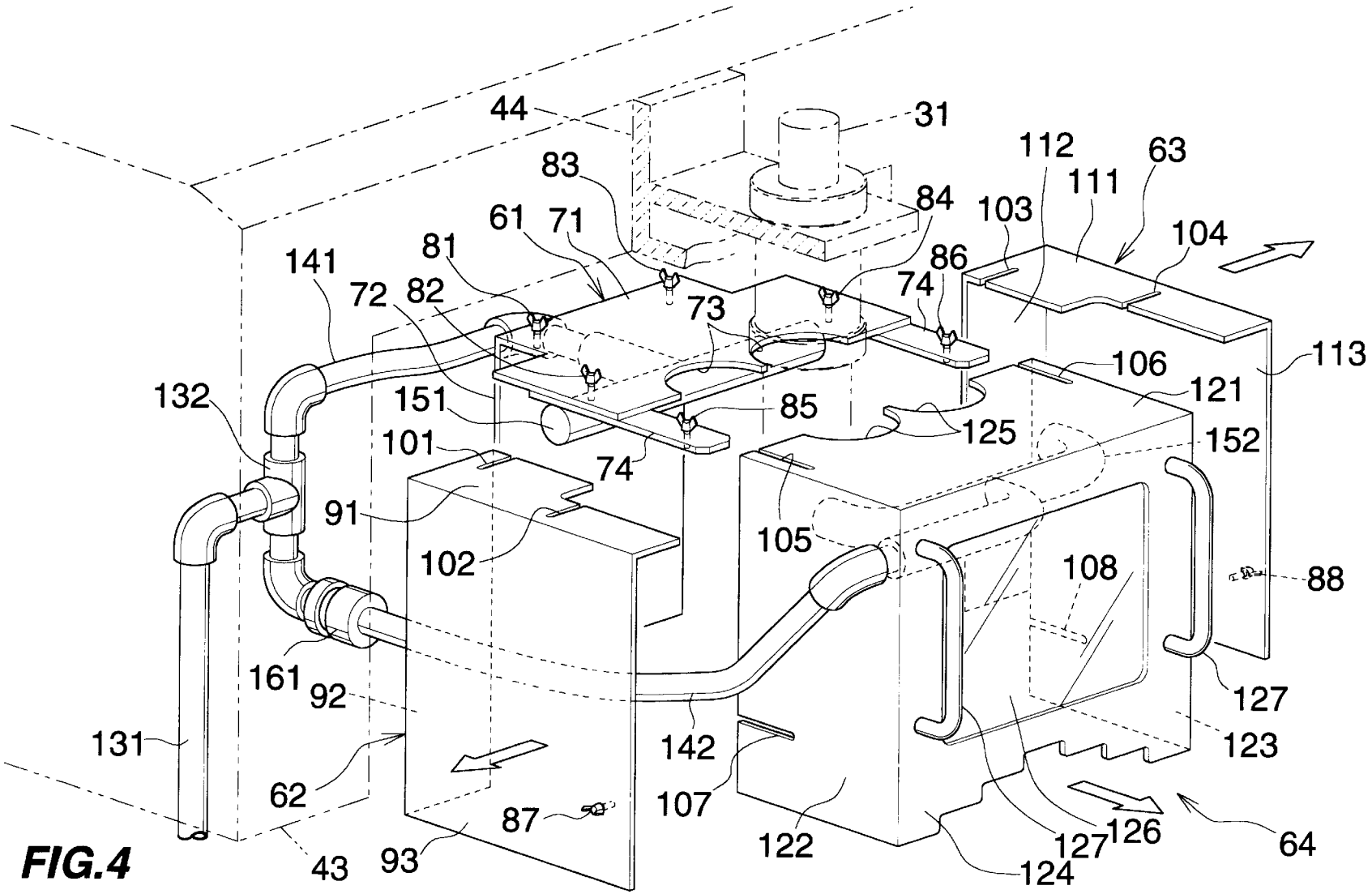
FIG. 4 is an exploded perspective view of an air cover of the condensation preventing device.

As shown in greater detail in FIG. 4, the air cover 51 comprises a left fixed cover 61, front movable cover 62, rear movable cover 63 and right movable cover 64.

The left fixed cover 61 is L-shaped in vertical section and comprises a horizontal top wall 71 and a vertical left side wall 72. The top wall 71 has a right edge portion formed with two semicircular left cutouts 73 each having fitted therein the left half of upper end of small diameter portion 42 of the filling nozzle 31. First and second thumbscrews 81, 82 are screwed in the front edge of the top wall 71, and third and fourth thumbscrews 83, 84 in the rear edge thereof. Two brackets 74 each in the form of a horizontal arm and projecting rightward are provided beneath the top wall 71 respectively at the front and rear two end portions thereof. Fifth and sixth thumbscrews 85, 86 are screwed in the right ends of the respective brackets 74. The left side wall 72 is fixed to the gate frame 43 by unillustrated suitable means.

The front movable cover 62 comprises a horizontal top wall 91, vertical left side wall 92 and vertical front side wall 93. The top wall 91 has a rear edge portion formed with long and short first and second slits 101, 102 left open at their rear ends and corresponding to the first and second thumbscrews 81, 82. A seventh thumbscrew 87 is screwed in the front side wall 93.

The rear movable cover 63, which faces toward a direction opposite to the front movable cover 62 with respect to the direction of transport path, comprises a top wall 111, left side wall 112 and rear side wall 113. The top wall 111 has a front edge portion formed with long and short third and fourth slits 103, 104 left open at their front ends and corresponding to the third and fourth thumbscrews 83, 84. An eighth thumbscrew 88 is screwed in the rear side wall 113.

The right movable cover 64 is in the form of a box left open at its left side and bottom side, and comprises a horizontal top wall 121, vertical front side wall 122, vertical rear side wall 123 and vertical right side wall 124. The top wall 121 has a left edge portion formed with two right cutouts 125 corresponding to the left cutouts 73. To the front and rear of the respective cutouts 125, the top wall 121 is formed with fifth and sixth slits 105, 106 corresponding to the fifth and sixth thumbscrews 85, 86. The front side wall 122 is formed with a seventh slit 107 corresponding to the seventh thumbscrew 87. The rear side wall 123 is formed with an eighth slit 108 corresponding to the eighth thumbscrew 88.

The right side wall 124 has a transparent inspection window 126 centrally thereof, and handles 127 at opposite sides of the window.

Figure 3:
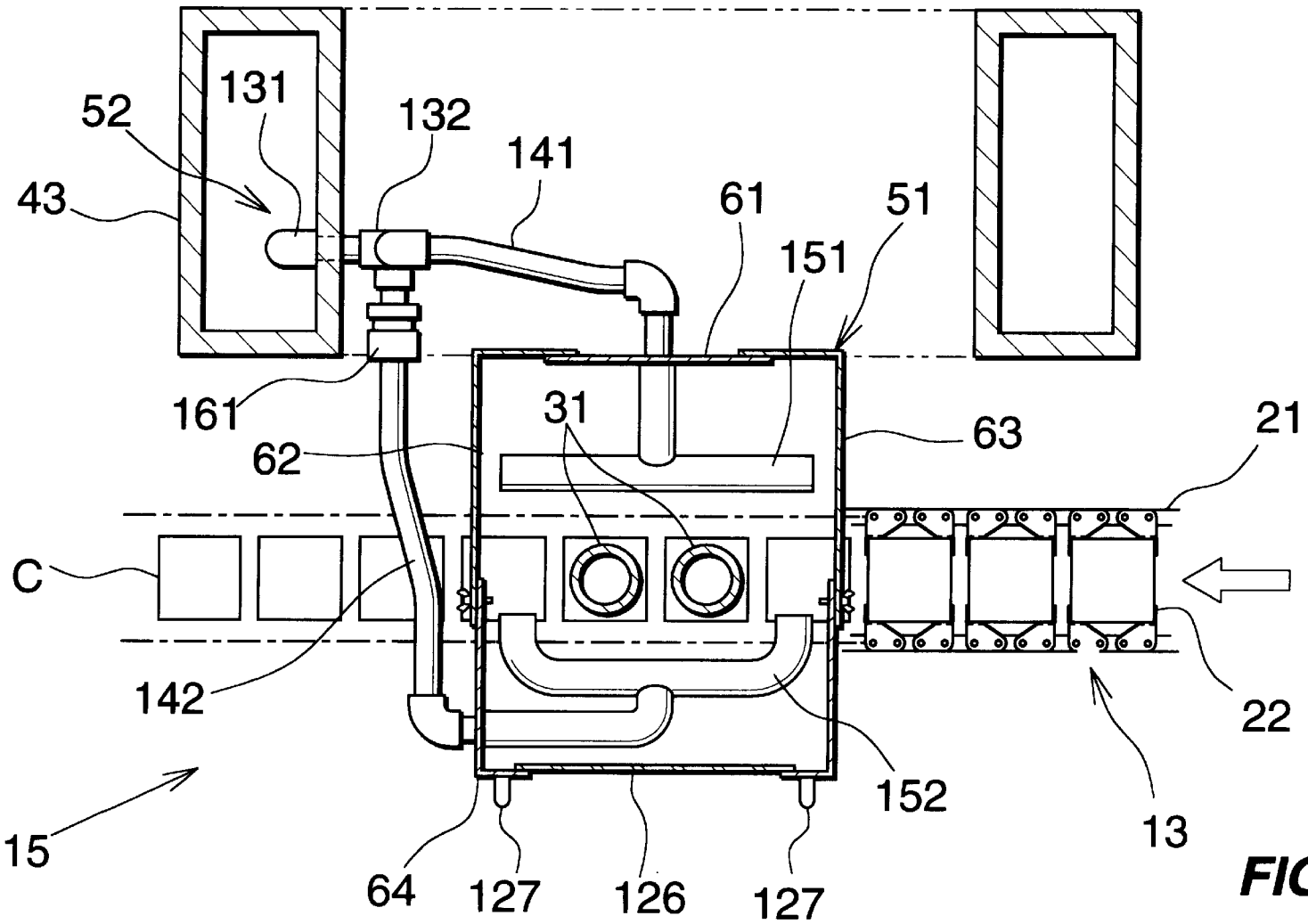
FIG. 3 is a horizontal cross sectional view of a condensation preventing device included in the device.

As is most apparently shown in FIG. 3, the air pipe 52 comprises a main pipe 131 extending from an air source 130 (see FIG. 1) and having an open outlet end at one side of the air cover 51, and first and second subpipes 141, 142 connected at inlet ends thereof to the outlet end of the main pipe 131 by a branch pipe 132.

The first subpipe 141 has an outlet end penetrated through the left side wall 72 of the fixed cover 61 and secured to the fixed cover 61 by welding at the penetration. Connected to the outlet end of the first subpipe 141 is a first air discharge nozzle 151, which is in the form of a horizontal pipe extending longitudinally of the transport path at the left side of the filling nozzles 31. The nozzle 151 has orifices facing downward and arranged in a row longitudinally of the path.

The second subpipe 142 has an outlet end penetrated through the front side wall 122 of the right movable cover 64 and secured to this cover 64 by welding at the penetration. Connected to the outlet end of the second subpipe 142 is a second air discharge nozzle 152, which is in the form of a horizontal pipe extending longitudinally of the transport path at the right side of the filling nozzles 31. The nozzle 152 has orifices facing downward and arranged in a row longitudinally of the path.

The first and second subpipes 141, 142 each comprise a flexible hose. A snap-in coupler 161 is interposed between the branch pipe 132 and the inlet end of the second subpipe 142.

The air cover 51 is assembled from the disassembled state shown in FIG. 4 by attaching the front movable cover 62 and the rear movable cover 63 to the fixed cover 61 first. For this purpose, the front movable cover 62 is moved rearward, and the rear movable cover 63 is moved forward so as to fit the first to fourth thumbscrews 81 to 84 into the corresponding first to fourth slits 101 to 104, respectively. The first to fourth thumbscrews 81 to 84 are thereafter tightened up. Subsequently, the right movable cover 64 is attached to the fixed cover 61 by fitting the fifth to eighth thumbscrews 85 to 88 into the corresponding fifth to eighth slits 105 to 108, respectively, while moving the right movable cover 63 leftward, and tightening up the fifth to eighth thumbscrews 85 to 88. Finally, the inlet end of the second subpipe 142 which has been detached is connected to the branch pipe 132 by the snap-in coupler 161.

The air cover 51 can be disassembled by removing the right movable cover 64 first and then the front and rear movable covers 62, 63 while loosening the corresponding thumbscrews 81 to 88 successively.

When dry air is supplied to the interior of the air cover 51 as assembled, the dry air flows downward within the cover

51 around the filling nozzles 31, whereby the nozzles 31 are held in a dry atmosphere and made free of condensation of water vapor. Furthermore, the dry air is held clean at all times by a filter, thus maintaining the filling nozzles 31 in a clean environment at all times.

What is claimed:

1. A liquid filling device comprising a filling nozzle for filling contents into containers being transported by a conveyor, and a lifter for lifting the container to be filled from a path of transport the filling nozzle having a lower portion providing a vertical cylinder portion fittable with the container to be lifted by the lifter, the liquid filling device being characterized in that the filling nozzle is provided with an air cover, the air cover including a top wall and a peripheral wall extending downward from an edge portion of the top wall and wherein the air cover has a fixed cover and a movable cover removably attached to the fixed cover, the filling nozzle extending through the top wall, at least the vertical cylinder portion of the entire filling nozzle projecting into the air cover, the air cover having connected thereto an outlet of a dry air pipe, wherein the dry air pipe comprises a fixed pipe, and a movable pipe having one end removably connected to the fixed pipe and the other end providing the outlet, the movable pipe having its outlet end secured to the movable cover.

2. A liquid filling device according to claim 1 wherein the movable pipe comprises a flexible hose.

* * * * *